US005150643A

United States Patent [19]

Saita

[11] Patent Number: 5,150,643

[45] Date of Patent: Sep. 29, 1992

[54] RECIPROCATING ACTUATOR

[75] Inventor: Seiji Saita, Yokohama, Japan

[73] Assignee: Kabushiki Kaisha Yamada Corp., Tokyo, Japan

[21] Appl. No.: 602,119

[22] Filed: Oct. 22, 1990

[30] Foreign Application Priority Data

Nov. 16, 1989 [JP] Japan ..... 1-297945

[51] Int. Cl.[5] ..... F01L 21/04; F01L 25/02

[52] U.S. Cl. ..... 91/229; 91/318; 91/321; 91/327; 92/181 R

[58] Field of Search ..... 91/222, 224, 226, 227, 91/228, 229, 318, 321, 323, 325, 327, 422; 92/131, 181 R, 181 P, 182, 183, 184, 185; 60/36

[56] References Cited

U.S. PATENT DOCUMENTS

| | | | |
|---|---|---|---|
| 889,058 | 9/1908 | Lewis | 91/229 |
| 1,767,214 | 6/1930 | Kelly | 91/229 |
| 2,987,051 | 6/1961 | Goyette et al. | 91/229 |
| 3,094,938 | 6/1963 | Blomeke et al. | 91/229 |
| 3,426,655 | 2/1969 | Rumsey | 92/184 |
| 4,587,732 | 5/1986 | Lind et al. | 91/229 |

*Primary Examiner*—Edward K. Look
*Assistant Examiner*—Hoang Nguyen
*Attorney, Agent, or Firm*—Morrison Law Firm

[57] ABSTRACT

An actuator is driven in a first direction by equal working fluid pressures acting on different piston areas acting in opposite directions, and is driven in a second direction by applying equal pressures on both sides of one of the piston areas. Working fluid from an inlet port, acting in a working fluid chamber, pushes up a valve plate, closes ventilation holes and opens working fluid discharge holes, thereby permitting the working fluid to push the piston upward. Working fluid contained in the working fluid chamber is exhausted from working fluid discharge holes to the outside of the system through a working fluid discharge pipe. When the upward movement of piston reaches its limit, a valve plate is pushed by a spring, thereby causing simultaneous closing of the working fluid discharge holes and the opening of the ventilation holes. As a result of the opened ventilation holes, working fluid pressures in a lower working fluid chamber and an upper working fluid chamber become equal. The working area acting downward is greater than the working area acting upward to generate a net downward force uring the piston downward. The working fluid discharge pipe fluid-tightly fitted through the piston to provide a discharge path of working fluid from the system.

1 Claim, 2 Drawing Sheets

RECIPROCATING ACTUATOR

BACKGROUND OF THE INVENTION

1. Field of the Invention

The present invention relates to a reciprocating actuator with a directional control valve that minimizes the length of the actuator by eliminating the need for an auxiliary cylinder in the actuator assembly.

2. Description of the Prior Art

A conventional reciprocating type actuator, such as the one disclosed in Japanese Utility Model Publication No. 37829/1986, has a configuration comprising a single-rod type piston slidably fitted in a cylinder with a directional control valve mechanism attached to the piston. Valve mechanism switching, at each end of reciprocating stroke, transfers a working fluid into the alternate of two working fluid chambers formed in the cylinder and separated from each other by the piston.

A conventional reciprocating actuator must have an auxiliary cylinder below the main cylinder into which the piston is retracted. The auxiliary cylinder has an axial length sufficient for the full stroke length of the piston so that when the piston moves upward, discharge of working fluid above the piston is accomplished regardless of the position of the piston. A reciprocating actuator having a directional control valve mechanism attached to the piston, such as the above example, requires that the actuator assembly have sufficient length in the axial direction, as determined by the length of the discharge auxiliary cylinder, to enable discharge.

OBJECTS AND SUMMARY OF THE INVENTION

It is an object of the present invention to provide a reciprocating actuator of shortened length by using a directional control valve that eliminates the need for an auxiliary cylinder at one end of the actuator.

The invention provides a reciprocating actuator having a single-rod type piston slidably fitted into a cylinder with a directional control valve mechanism attached to the piston. An upper and a lower fluid chamber is formed inside the cylinder and separated by the piston. The piston encircles, and travels within the cylinder, along the length of a working fluid discharge pipe having three inner discharge openings within the length of the pipe and terminated at one end by a cap with a working fluid outlet port. Each inner discharge opening is connected to a corresponding working fluid discharge hole in the directional control valve fixed to the piston.

Complementing the three working fluid discharge holes in the directional control valve are three ventilation holes. Each set of holes alternately switches to an open or closed state at the end of each actuator stroke. When the working fluid discharge holes open at the end of the stroke farthest from the cap, the ventilation holes close, allowing working fluid (or air) entering an inlet port on the body of the actuator to fill the lower working fluid chamber. Exhaust of working fluid in the upper working fluid chamber is released through the vent outlet as the piston commences travel towards the cap end of the actuator. At the end of the stroke towards the cap end of the actuator, the discharge and ventilation holes in the directional control valve assume alternate states, causing the working fluid discharge holes to close and the ventilation holes to open, allowing working fluid to fill the upper working fluid chamber, thus reversing the direction of stroke away from the cap end of the actuator. Reciprocating movement of the plunger attached to the piston continues as long as working fluid is introduced at the inlet port of the actuator.

Briefly stated, the present invention provides an actuator that is driven in a first direction by equal working fluid pressures acting on different piston areas acting in opposite directions, and is driven in a second direction by applying equal pressures on both sides of one of the piston areas. Working fluid from an inlet port, acting in a working fluid chamber, pushes up a valve plate, closes ventilation holes and opens working fluid discharge holes, thereby permitting the working fluid to push the piston upward. Working fluid contained in the working fluid chamber is exhausted from working fluid discharge holes to the outside of the system through a working fluid discharge pipe. When the upward movement of piston reaches its limit, a valve plate is pushed by a spring, thereby causing simultaneous closing of the working fluid discharge holes and the opening of the ventilation holes. As result of the opened ventilation holes, working fluid pressures in a lower working fluid chamber and an upper working fluid chamber become equal. The working area acting downward is greater than the working area acting upward, generating a net downward force urging the piston downward. The working fluid discharge pipe is fluid-tightly fitted through the piston to provide a discharge path of working fluid from the system.

According to an embodiment of the invention, there is provided a reciprocating actuator comprising: a cylinder, a single-rod piston slidably fitted in the cylinder, the single-rod piston dividing the cylinder into first and second working fluid chambers, a plunger connected to the single-rod piston, means for permitting the single-rod piston and the plunger to move in a reciprocating motion within the cylinder, a directional control valve mechanism, the directional control valve mechanism including means, effective at ends of the reciprocating motion, for switching the supplying and discharging of working fluid into and from the first and second working fluid chambers, a working fluid discharge pipe extending from one end through an entire length of the cylinder, means for sealing the working fluid discharge pipe to the single-rod piston, at least one inner hole running the length of the working fluid discharge pipe, and the directional control valve mechanism including means for releasing the working fluid from the first working fluid chamber into the at least one inner hole during travel of the single-rod piston in one direction of its reciprocating motion.

According to a feature of the invention, there is provided a reciprocating actuator comprising: a cylinder, a single-rod piston, a plunger connected to the single-rod piston, an inner hole axially disposed in the plunger, means for permitting reciprocating motion of the single-rod piston and the plunger in the cylinder, the inner hole being blind, a working fluid discharge pipe stationary in the cylinder, means for sealing the working fluid discharge pipe in fluid communication with the inner hole, and means, effective during operation of the reciprocating actuator, for valving working fluid from the cylinder into the inner hole, whereby the working fluid is exhausted from at least a portion of the cylinder through the working fluid discharge pipe.

The above, and other objects, features and advantages of the present invention will become apparent from the following description read in conjunction with the accompanying drawings, in which like reference numerals designate the same elements.

DETAILED DESCRIPTION OF PREFERRED EMBODIMENTS

Figure 1:
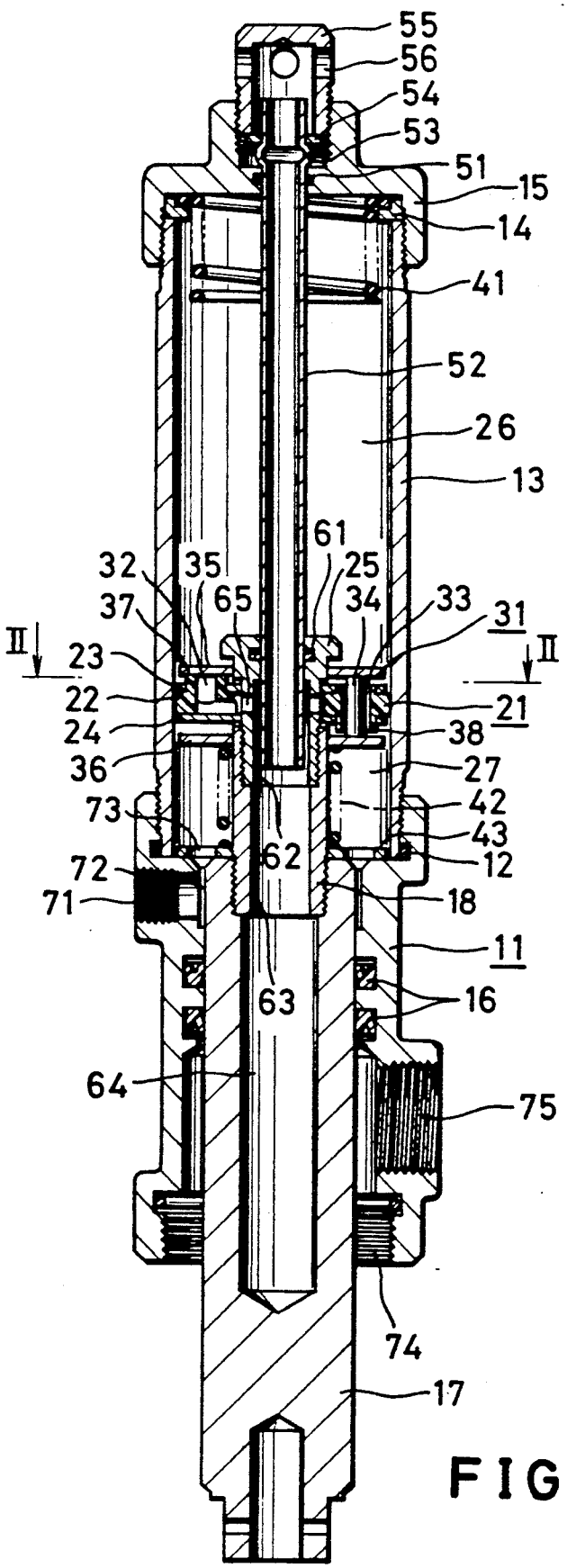
FIG. 1 is a cross section showing an embodiment of a reciprocating actuator according to the present invention.

Referring to FIG. 1, a reciprocating actuator of the current invention has a cylinder 13 screwed to a body 11, with an O-ring 12 between. A cap 15 is integrally screwed around the cylinder 13, with packing 14 between. A plunger 17 is so fitted in body 11 with packing 16 between as to be vertically slidable within body 11 and integrally attached to a single-rod piston 21 through a rod 18.

Single-rod piston 21 consists of packing 22 fitted in cylinder 13 and interposed between an upper washer 23 and a lower washer 24. Packing 22 and upper washer 23 and lower washer 24 are clamped together by rod 18 and a plug 25 screwed into rod 18. Single-rod piston 21 separates the space inside cylinder 13, forming an upper working fluid chamber 26 and a lower working fluid chamber 27 in cylinder 13.

A directional control valve 31 is attached to single-rod piston 21. Directional control valve 31 switches at both ends of reciprocating movement for the supply and discharge of working fluid in and out of upper and lower working fluid chambers 26 and 27. Directional control valve 31 has coupler 34 movably fitted in working fluid discharge holes 32 and ventilation holes 33 formed in single-rod piston 21. Working fluid discharge holes 32 serve as exhaust holes for working fluid. Coupler 34 incorporates an upper valve plate 35 and a lower valve plate 36 into one body. The upper valve plate 35 faces upper valve seats 37 of working fluid discharge holes 32 and lower valve plate 36 faces lower valve seats 38 of ventilation holes 33.

At the top of cylinder 13, the upper valve plate 35 is contacted by an upper spring 41 at an end of the actuator stroke nearer the cap 15. Upper valve plate 35 presses downward on coupler 34, thereby urging lower washer 24 out of contact with working fluid discharge holes 32. At the opposite end of the stroke, the lower valve plate 36 is contacted and urged upward by a lower spring 42 fitted around rod 18. The lower spring 42, which is disposed between washer 43 and held by plunger 17 and upper valve plate 35, pushes lower valve plate 36 toward the cap 15 end of the actuator, thereby moving lower washer 24 into sealing contact with working fluid discharge holes 32.

Figure 2:
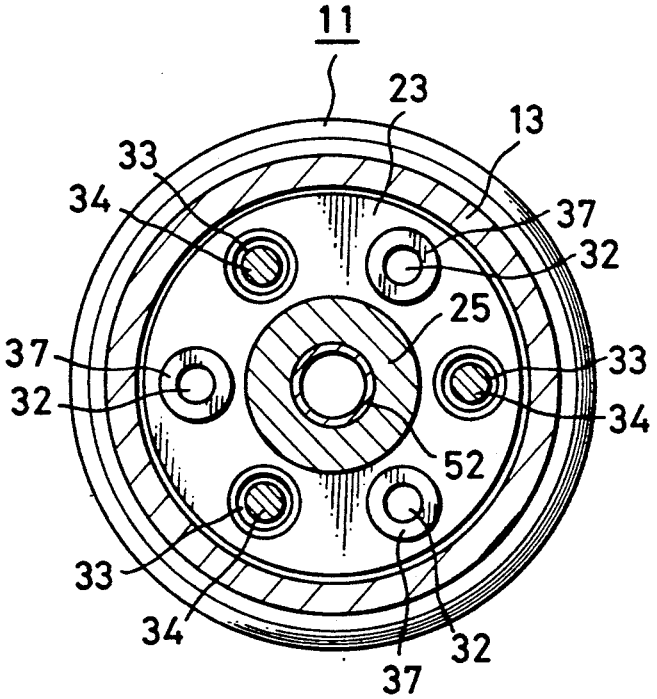
FIG. 2 is a cross section of the reciprocating actuator taken along line II—II in FIG. 1.

Referring now to FIG. 2, the coupler 34 and working fluid discharge holes 32 provided in the directional control valve 31 are three each.

Returning to FIG. 1, a working fluid discharge pipe 52 is inserted in cylinder 13 from cap 15 at the end opposite to the rod 18 along substantially the complete length of cylinder 13. An O-ring 51 and a protruding part 53 of working fluid discharge pipe 52 are fixed through a stopper 54 to an exhaust cylinder 55 screwed to cap 15. Exhaust cylinder 55 includes an exhaust port 56 to allow exhaust of working fluid from upper working fluid chamber 26.

Plug 25 of single-rod piston 21 is slidably sealed to working fluid discharge pipe 52 by an O-ring 61. Inner holes 62, 63 and 64 are formed in the center of plug 25, rod 18 and plunger 17 respectively. Working fluid discharge holes 32 of directional control valve 31 are connected through a horizontal hole 65 bored in plug 25 and one of the inner holes 62, 63 and 64 to working fluid discharge pipe 52.

An inlet port 71 in body 11 leads through space 72 and plunger 17 to lower working fluid chamber 27. When washer 43 abuts body 11, air is supplied through a hole 73 bored in washer 43 into lower working fluid chamber 27.

A threaded hole 74 in body 11 connects a pump discharge port 75 to an external pump mechanism. Explanation of the external pump is omitted herein.

A description of the functioning of the present embodiment follows.

As shown in FIG. 1, when single-rod piston 21 is in its uppermost position, toward the cap end of the actuator, upper valve seats 37 of working fluid discharge holes 32 are closed by upper valve plate 35. At the same time, lower valve seats 38 of ventilation holes 33 are opened by the action of couplers 34 acting on lower valve plate 36. This causes air pressure supplied from inlet port 71 into lower working fluid chamber 27 to be applied also to upper working fluid chamber 26 through ventilation holes 33, thereby applying virtually the same air pressure on both the top and the bottom of single-rod piston 21. The areas of the surfaces of single-rod piston 21 which receive the pressure are different, i.e., the upper (rod 18 end) surface is greater than the lower surface (end opposite rod 18). The lower surface area being less than the upper end area by the amount of the sectional area of plunger 17, causes single-rod piston 21 to move downward in the direction of the rod 18.

At the end of the downward stroke (towards the rod) of single-rod piston 21, the lower spring 42 urges upper valve plate 35 and lower valve plate 36 in the upward direction, causing upper valve seats 37 of working fluid discharge holes 32 to open and lower valve seats 38 to close. As a result, pressure of the air supplied from inlet port 71 into lower working fluid chamber 27 works only upon the lower surface of single-rod piston 21, thus urging single-rod piston 21 to move in the upward direction. At that time, air contained in upper working fluid chamber 26 is discharged through working fluid discharge holes 32, horizontal hole 65, inner holes 62, 63 and 64 of working fluid discharge pipe 52 and exhaust port 56 of exhaust cylinder 55 to the outside of the system.

At the end of the upward stroke single-rod piston 21, upper valve plate 35 abuts and compresses upper spring 41 to the point where the upper valve plate 35 and lower valve plate 36 are pushed downward in relation to the upward movement of single-rod piston 21. At this point, upper valve seats 37 of working fluid discharge holes 32 close, and lower valve seats 38 of ventilation holes 33 open, causing single-rod piston 21 to reverse direction to the downward stroke.

Having described preferred embodiments of the invention with reference to the accompanying drawings, it should be understood that the invention is not limited to those precise embodiments, and that changes and modifications may be effected therein by one skilled in the art without departing from the scope or spirit of the invention as defined in the appended claims.

What is claimed is:

1. A reciprocating actuator comprising:

a cylinder;

a single-rod piston slid ably fitted in said cylinder;

said single-rod piston dividing said cylinder into first and second working fluid chambers;

a plunger connected to said single-rod piston;

means for permitting said single-rod piston and said plunger to move in a reciprocating motion within said cylinder;

a directional control valve mechanism;

said directional control valve mechanism including means, effective at ends of said reciprocating motion, for switching the supplying anal discharging of working fluid into and from said first and second working fluid chambers;

a working fluid discharge pipe extending from one end through an entire length of said cylinder;

means for sealing said working fluid discharge pipe to said single-rod piston;

at least one inner hole running the length of said working fluid discharge pipe;

and said directional control valve mechanism including means for releasing said working fluid from said first working fluid chamber into said at least one inner hole during travel of said single-rod piston in one direction of its reciprocating motion;

said directional control valve includes:

an upper valve plate;

a washer below said upper valve plate;

at least one working fluid discharge hole in said washer;

a valve seat in said washer;

at least one ventilation hole in said washer;

at least one coupler passing slid ably through said washer;

said at least one working fluid discharge hole communicating with said at least one inner hole, thereby allowing working fluid to enter said at least one inner hole and exhaust through said at least one inner hole;

said at least one ventilation hole communicating, between said first and second working fluid chambers;

means for closing said at least one working fluid discharge hole by said upper valve plate at a first extreme of motion;

a lower valve plate; and means for closing said at least one ventilation hole by said lower plate at a second extreme of motion.

* * * * *